United States Patent [19]

Jones

[11] Patent Number: 4,965,888

[45] Date of Patent: Oct. 30, 1990

[54] SURROGATE NURSING BIB

[76] Inventor: Stacye C. Jones, 456 S. Harvard Blvd., Los Angeles, Calif. 90020

[21] Appl. No.: 378,374

[22] Filed: Jul. 11, 1989

[51] Int. Cl.[5] ..... A41D 1/20

[52] U.S. Cl. ..... 2/104; 2/49 R

[58] Field of Search ..... 2/48, 49 R, 49 A, 50, 2/51, 52, 104; 224/148, 251, 901; 248/102, 104; 446/28; 450/39; 604/77

[56] References Cited

U.S. PATENT DOCUMENTS

| | | | |
|---|---|---|---|
| 2,061,268 | 11/1936 | Becker | 450/39 |
| 2,538,677 | 1/1951 | Ferrand | 2/48 |
| 2,665,426 | 1/1954 | Schmidt | 2/49 R |
| 2,707,281 | 5/1955 | Barth | 450/39 |
| 2,721,323 | 10/1955 | Spanel et al. | 450/39 |
| 3,478,739 | 11/1969 | Librande | 450/39 X |
| 3,811,133 | 5/1974 | Harris | 450/39 |
| 4,220,302 | 9/1980 | Hampton et al. | 224/901 X |
| 4,498,613 | 2/1985 | Donahue et al. | 248/102 X |
| 4,537,341 | 8/1985 | Kelly | 248/104 X |
| 4,632,263 | 12/1986 | Gertzman | 215/11.1 |
| 4,754,887 | 7/1988 | Ou | 215/11.1 X |
| 4,776,546 | 10/1988 | Goldson et al. | 248/102 |

*Primary Examiner*—Werner H. Schroeder
*Assistant Examiner*—J. Chapman
*Attorney, Agent, or Firm*—W. Edward Johansen

[57] ABSTRACT

A surrogate nursing bib is used by a wearer in promoting bonding with a child. The surrogate nursing bib includes a bib, a first set of VELCRO straps, a second set of VELCRO straps and at least one container. The bib is formed out of latex in order to provide a natural-looking background for the child. The bib has a inner side and an outer side. A cotton lining is disposed on the inner side. At least one pouch is disposed on the outer side. The pouch has an opening. The first set of VELCRO straps is mechanically coupled to the bib in order to secure the bib to the neck of the wearer. The second set of VELCRO straps is mechanically coupled to the bib in order to secure the bib to the waist of the wearer. The container has a nipple on which the child may suckle. The container is disposed in the pouch so that the nipple protrudes through the opening in the pouch.

2 Claims, 2 Drawing Sheets

Fig. 3.
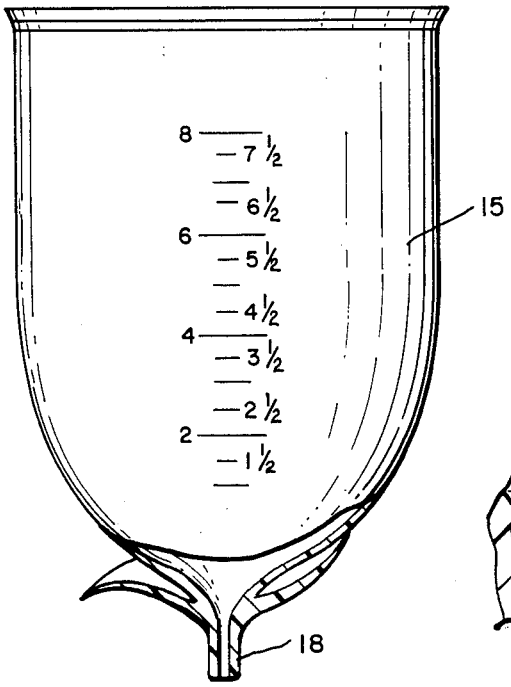
Fig. 4.
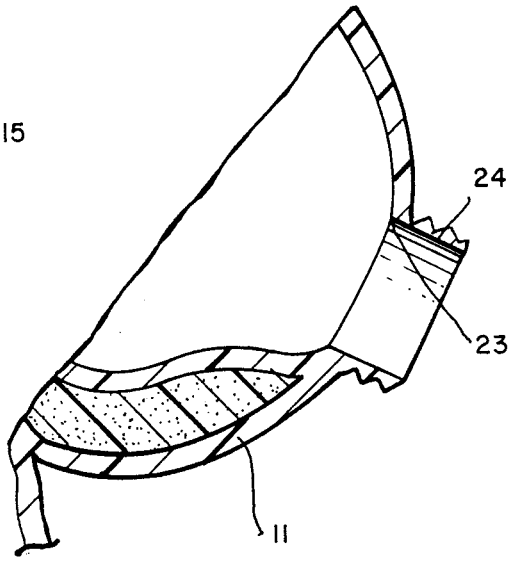
Fig. 5.
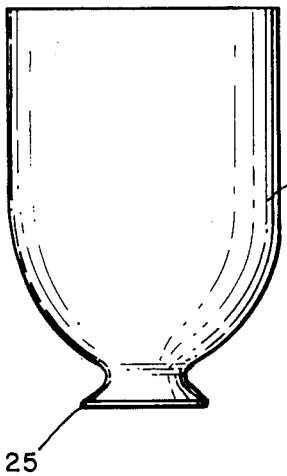
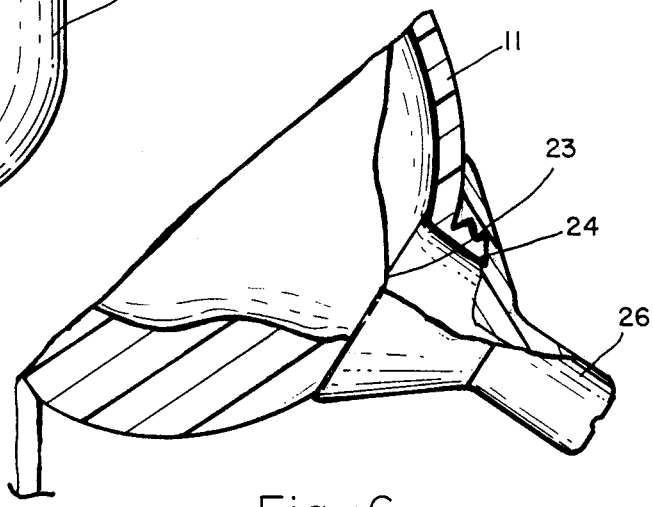
Fig. 6.

SURROGATE NURSING BIB

BACKGROUND OF THE INVENTION

1. Field of the Inventions

The present invention relates to a parent-child bonding bib for use in promoting parent-child bonding and more particularly to a surrogate nursing bib which utilizes two sets of VELCRO straps to secure it to the neck and waist of a wearer and the bib of which is formed from a latex material with a cotton lining to provide a natural-looking background for the child.

2. Description of the Prior Art

The process of bonding between a child, especially an infant, and a parent serves as the foundation for an emotionally stable and physically healthy individual. Scientific research indicates that bonding takes place during nursing because the mother strokes the child with her free hand and not because of the difference between the breast and the bottle. A bottle-fed child is deprived of the strokes that it gets from the mother. It is for this reason that bonding does not take place. This process can only take place naturally between the child and the mother thus depriving the father, or another related individual, and the child of the opportunity to have this bonding relationship. Children have traditionally had supplemental mammary suckling with water or nourishment from a nipple-bearing container.

U.S. Pat. No. 4,776,546, entitled Parent-Child Bonding Bib, entitled Alfred L. Goldson on Oct. 11, 1988, teaches a parent-child bonding bib which assists in nursing a child in order to improve bonding between a parent and the child. The parent-child bonding bib includes a bib-like structure and at least one pouch. The bib-like structure is made from a fabric, such as terry cloth, so that it is comfortable for the child, and includes a generally mammary shaped area defining a pouch. The pouch retains a container of liquid, such as formula, milk, juice, or water of the child. The pouch is sized to receive the container therein and communicates with a opening in the fabric for permitting a nipple on the container to protrude therefrom. When worn by either parent, the parent-child bonding bib improves bonding between the child and the parent, especially for the male, by anatomically simulating the female.

U.S. Pat. No. 4,498,613, entitled Support Device for Nursing Bottles and Amusement Items, issued to Barbara S. Donahue on Feb. 12, 1985, teaches a support device for nursing bottles and amusement items. U.S. Pat. No. 4,537,341, entitled Nursing Bottle Holder, issued to Oscar Kelly on Aug. 27, 1985, teaches a nursing bottle holder.

U.S. Pat. No. 4,797,953 teaches a nursing shawl. U.S. Pat. No. 4,660,225 teaches an ornamental bib and protective bib. U.S. Pat. No. 4,811,428 teaches a washable and disposable bib.

SUMMARY OF THE INVENTION

In view of the foregoing factors and conditions which are characteristic of the prior art it is the primary object of the present invention to provide a surrogate nursing bib which includes a pouch for use in suckling a child in order to promote bonding between a child and a wearer and which utilizes a set of VELCRO straps to secure it to the neck and waist of the wearer.

It is another object of the present invention to provide a surrogate nursing bib which has a bib which is formed from a latex material to provide a natural-looking background for the child.

In accordance with the present invention an embodiment of a surrogate nursing bib which is used by a wearer in promoting bonding with a child is described. The surrogate nursing bib includes a bib, a first set of hook and loop pile VELCRO straps, a second set of VELCRO straps and at least one container. The bib is formed out of latex in order to provide a natural-looking background. The bib has a inner side and an outer side. A cotton lining is disposed on the inner side. At least one pouch is disposed on the outer side. The pouch has an opening. The first set of VELCRO straps is mechanically coupled to the bib in order to secure the bib to the neck of the wearer. The second set of VELCRO straps is mechanically coupled to the bib in order to secure the bib to the waist of the wearer. The container has a nipple on which the child may suckle. The container is disposed in the pouch so that the nipple protrudes through the opening in the pouch.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE, DRAWING

FIG. 3 is top plan view of the container of FIG. 2 of the surrogate nursing bib of FIG. 1.

FIG. 4 is an enlarged side elevation in cross-section of the second pouch of the surrogate nursing bib of FIG. 1 taken along line 4—4 of FIG. 1. showing the threaded portion thereof.

FIG. 5 is a side elevation of a second container which is inserted into the second pouch of FIG. 4 of the surrogate nursing bib of FIG. 1.

FIG. 6 is an enlarged side elevation in cross-section of the second container and the second pouch of the surrogate nursing bib of FIG. 1.

DESCRIPTION OF THE PREFERRED EMBODIMENT

Figure 1:
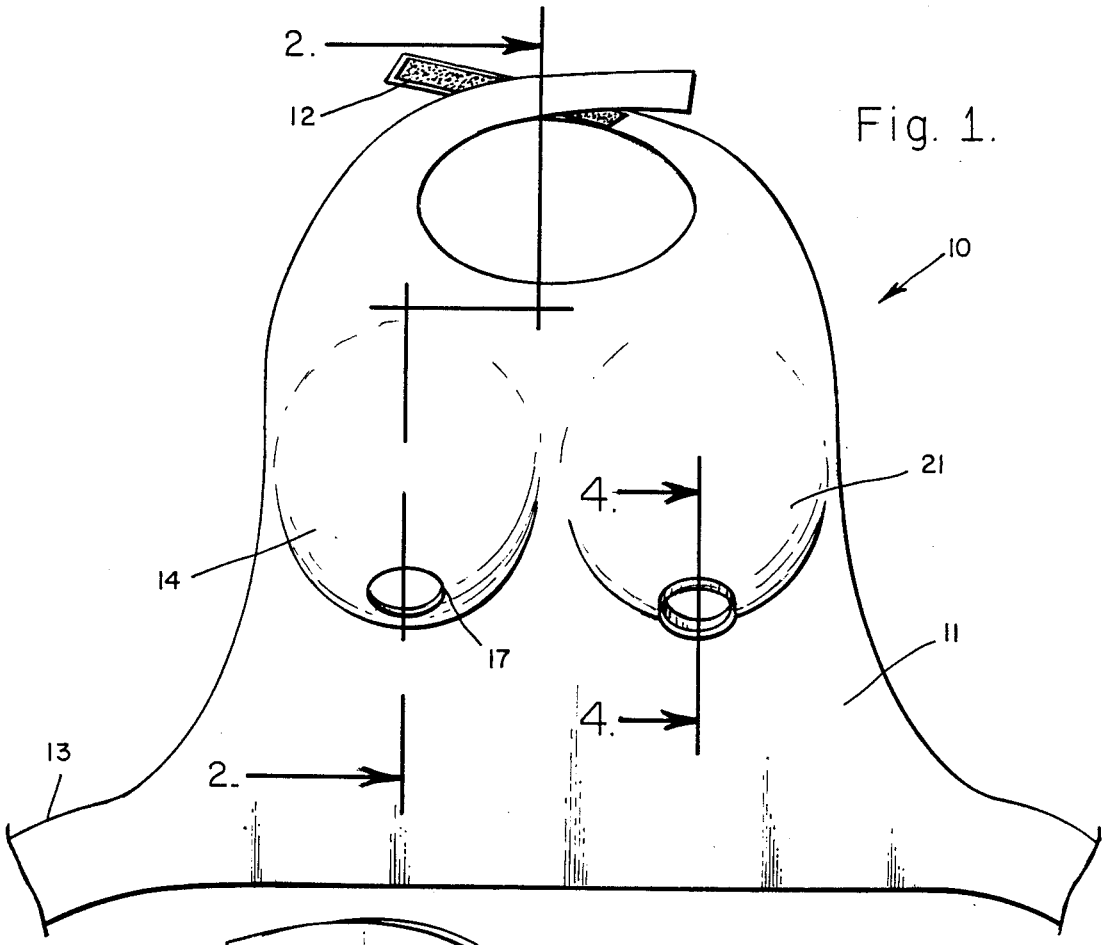
FIG. 1 is a perspective view of a surrogate nursing bib which includes a bib, a first pouch and a second pouch which has been made in accordance with the principles of the present invention.

In order to best understand the present invention it is necessary to refer to the following description of its preferred embodiment in conjunction with the accompanying drawing. Referring to FIG. 1 in conjunction with FIG. 2 a surrogate nursing bib 10 is used by a wearer in promoting bonding with a child. The surrogate nursing bib 10 includes a bib 11, a first set 12 of hook and loop pile VELCRO straps, a second set 13 of VELCRO straps, a first pouch 14 and a first container 15. The bib 11 is formed out of latex in order to provide a natural-looking background for the child. The bib 11 has a inner side and an outer side. A cotton lining 16 is disposed on the inner side. The first set 12 of VELCRO straps is mechanically coupled to the bib 11 in order to secure the bib 11 to the neck of the wearer. The second set 13 of VELCRO straps is mechanically coupled to the bib 11 in order to secure the bib 11 to the waist of the wearer.

Figure 2:
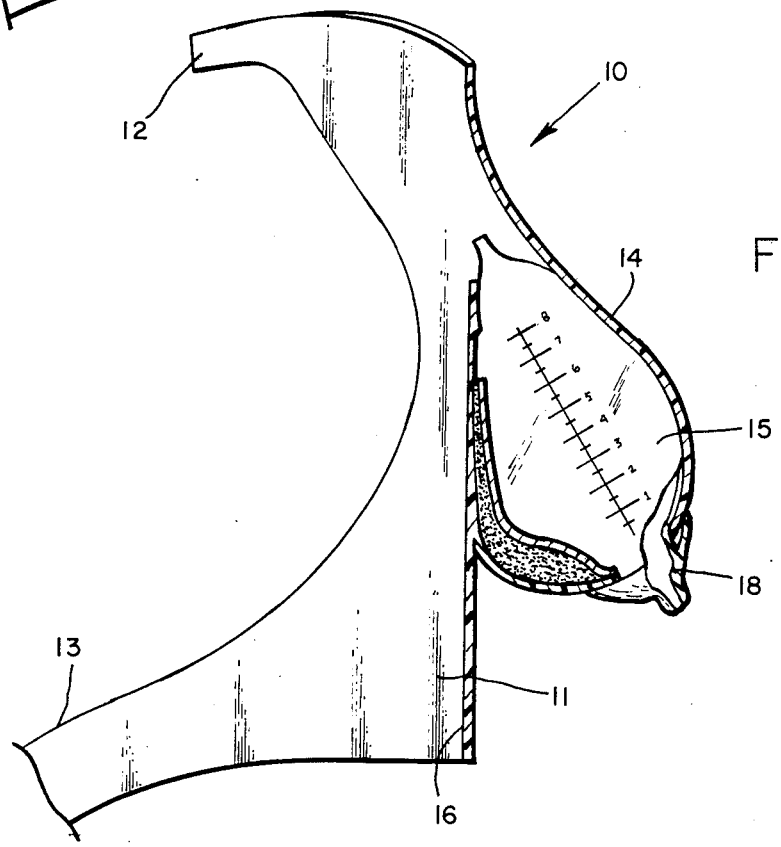
FIG. 2 is a side elevation in cross-section of the first pouch and the bib of the surrogate nursing bib of FIG. 1 and a first container with a nipple which is disposed in the first pouch taken along line 2—2 of FIG. 1.

Referring to FIG. 1 in conjunction with FIG. 2 and FIG. 3 the first pouch 14 is disposed on the outer side and has an opening 17. The first container 15 has a first nipple 18 on which the child may suckle. The container 15 is disposed in the first pouch 14 so that the first nipple 18 protrudes through the opening 17 in the first pouch 14.

Referring again to FIG. 1 the surrogate nursing bib 10 serves as a bonding device between a child and anyone who feeds it. There are differences between the parent-child bonding bib and the surrogate nursing bib 10. One of the differences is that the surrogate nursing bib 10 is geared towards individuals who are physically incapable of nursing a baby. A new mother may fit into this category. The surrogate nursing bib 10 does not assist in nursing rather it creates the opportunity for nursing where it did not exist before. The bib-like structure of the parent-child bonding bib is made from a fabric material. The exterior of the bib 11 of the surrogate nursing bib 10 is not made from the highest grade of flesh-tone, skin-like latex. The interior is made of a soft natural cotton so that it is geared towards the comfort of the wearer. The structure of the parent-child bonding bib which allows adaptation and which provides security consists of strings which are connected around the neck of the wearer with no lower abdominal support. There is no real stability of the parent-child bonding bib. The surrogate nursing bib 10 utilizes two sets 12 and 13 of VELCRO straps tied around the neck and the waist of the wearer thereby providing security and adjustability.

Referring to FIG. 1 in conjunction with FIG. 4 FIG. 5, and FIG. 6 a second embodiment of the surrogate nursing bib 10 may also include a second pouch 21 and a second container 22. The second pouch 21 is disposed on the outer side and has an opening 23 with a threaded end-piece 24. The second container 22 has an open end 25 which is inserted into the opening 23 through the threaded end-piece 24. A second nipple 26 which is threaded and on which the child may suckle is threaded over the open end 25 of the second container 22 and the threaded end-piece 24. The second container 22 is disposed in the second pouch 21 and the second nipple 26 is attached to the threaded end-piece 24 which protrudes through the opening 23 in the second pouch 21.

From the foregoing it can be seen that a surrogate nursing bib has been described.

It should be noted that the sketches are not drawn to scale and that distance of and between the figures are not to be considered significant.

What is claimed is:

1. A surrogate nursing bib for use by a wearer in promoting bonding with child, said surrogate nursing bib comprising:

a. a bib which is formed out of latex in order to provide a natural-looking background and which has a inner side and an outer side, a cotton lining being disposed on said inner side and at least one pouch being disposed on said outer side, said pouch having an opening;

b. a first set of straps having hook and loop fasteners which are mechanically coupled to said bib in order to secure said bib to the neck of the wearer;

c. a second set of straps having hook and loop fasteners which are mechanically coupled to said bib in order to secure said bib to the waist of the wearer; and d. at least one container which has a nipple on which an infant may suckle, said container being disposed in said pouch so that said nipple protrudes through said opening in said pouch.

2. A surrogate nursing bib according to claim 1 wherein said opening of said pouch is threaded so that it can receive a screw-on nipple.

* * * * *